US007466272B1

(12) United States Patent
Su et al.

(10) Patent No.: US 7,466,272 B1
(45) Date of Patent: Dec. 16, 2008

(54) DUAL-BAND ANTENNA

(75) Inventors: Jia-Hung Su, Taipei Hsien (TW); Ching-Chi Lin, Taipei Hsien (TW); Shih-Hao Hu, Taipei Hsien (TW); Hung-Jen Chen, Taipei Hsien (TW); Kai Shih, Taipei Hsien (TW); Yu-Yuan Wu, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/871,768

(22) Filed: Oct. 12, 2007

(51) Int. Cl.
*H01Q 1/38* (2006.01)

(52) U.S. Cl. ..... 343/700 MS; 343/702

(58) Field of Classification Search ..... 343/700 MS, 343/702, 846, 848
See application file for complete search history.

(56) References Cited

U.S. PATENT DOCUMENTS 6,812,892 B2 11/2004 Tai et al.
6,861,986 B2 3/2005 Fang et al.
7,289,071 B2 * 10/2007 Hung et al. ..... 343/702
7,292,194 B2 * 11/2007 Tai et al. ..... 343/702
7,339,536 B2 * 3/2008 Hung et al. ..... 343/702
7,362,277 B2 * 4/2008 Su ..... 343/702
7,429,955 B2 * 9/2008 Tai et al. ..... 343/702

* cited by examiner

*Primary Examiner*—HoangAnh T Le
(74) *Attorney, Agent, or Firm*—WPAT, P.C.; Anthony King

(57) ABSTRACT

A dual-band antenna has a ground portion, a connection portion with a feeding point separated from the ground portion and a short portion connected to the ground portion and the connection portion. The short portion and the ground portion are formed an acute angle therebetween. The connection portion respectively connect a first radiating portion and a second radiating portion. The first radiating portion and the second radiating portion are parallel to said ground portion. The short portion is arranged between the ground portion and the first radiating portion. When the dual-band antenna operates at wireless operation, the connection portion, the first radiating portion and the second radiating portion resonate to obtain a first frequency range and a second frequency range. The short portion is formed as a function of an inductance.

13 Claims, 4 Drawing Sheets

DUAL-BAND ANTENNA

BACKGROUND OF THE INVENTION

1. Field of the Invention

The invention relates to the field of antenna. More specifically, a dual-band antenna has a short portion as a function of an inductance.

2. The Related Art

According to the progress of the communication technology, the key development is the transfer from wired to wireless communication. A plurality of different wireless communication bands may be used by devices such as laptops. Therefore, antennas equipping multi-frequency operation for the laptops are one of the development points.

A conventional dual-band antenna is disclosed in U.S. Pat. No. 6,812,892 filed in 2002 Dec. 26. The dual band antenna has a planar conductive element and a feeder cable electronically connecting to the conductive element. The conductive element includes a first radiating strip, a second radiating strip, a ground portion and a connection strip interconnecting the first and the second radiating strips with the ground portion.

The first radiating strip and the connection strip are configured to function as a first planar inverted-F antenna (PIFA) operating in a higher frequency band. The second radiating strip and the connection strip are configured to function as a second PIFA operating in a lower frequency band. The first and the second radiating strips, the ground portion and the connection strip are all disposed in the same plane.

The connection strip includes a first segment, a third segment, and a second segment interconnecting the first and the third segments, the first segment extending from a joint of the first and the second radiating strips, and the third segment connecting with the ground portion.

Because the third segment of the connection strip is parallel to the second radiating strip, an electromagnetic interference is formed therebetween. The electromagnetic interference between the second radiating strip and the third segment may influence antenna characteristic of the lower frequency band of the dual-band antenna to decrease the efficiency of the lower frequency band of the dual-band antenna.

A conventional multifrequency inverted-F antenna is disclosed in U.S. Pat. No. 6,861,986 filed in 2003 Mar. 20. The multifrequency inverted-F antenna includes a radiating element having opposite first and second ends, a grounding element spaced apart from the radiating element, and an interconnecting element extending between the radiating and grounding elements and including first, second, and third segments.

The first segment is connected to the radiating element at a feeding point between the first and second ends. The second segment is offset from the first segment in a longitudinal direction, and is connected to the grounding element. The third segment interconnects the first and second segments. A feeding line is connected to the interconnecting element.

Furthermore, the radiating element and the third segment are formed an electromagnetic interference therebetween when the multifrequency inverted-F antenna operates in wireless operations. The electromagnetic interference between the radiating element and the third segment may influence antenna characteristic of the multifrequency antenna to decrease the efficiency of the multifrequency antenna.

SUMMARY OF THE INVENTION

An object of the present invention is to provide a dual-band antenna having a ground portion and a separately connection portion with a feeding point. The connection portion defines opposite sides respectively connected to a short portion and a second radiating portion. The short portion interconnects the connection portion and the ground portion to form an acute angle between the short portion and the ground portion. The short portion is arranged between the ground portion and a first radiating portion connected to the connection portion and parallel to the ground portion.

When the antenna operates at wireless operation, the resonance of the connection portion and the first radiating portion obtain a lower frequency range, and the resonance of the connection portion and the second radiating portion obtain a higher frequency range. The resonance of the short portion is as a function of an inductance. Because the acute angle is formed between the short portion and the ground portion, and the first radiating portion, the short portion is obliquely arranged between the ground portion and the first radiating portion. Therefore, the average interference between the short portion and the first radiating portion is reduced.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Structures of a dual-band antenna described herein are sized and shaped to tune the dual-band antenna for operation in wireless telecommunication bands. In an embodiment of the invention described in detail below, the dual-band antenna has structure which is primarily associated with operating bands covering 2.4 GHz band and 5.2 GHz band.

Figure 1:
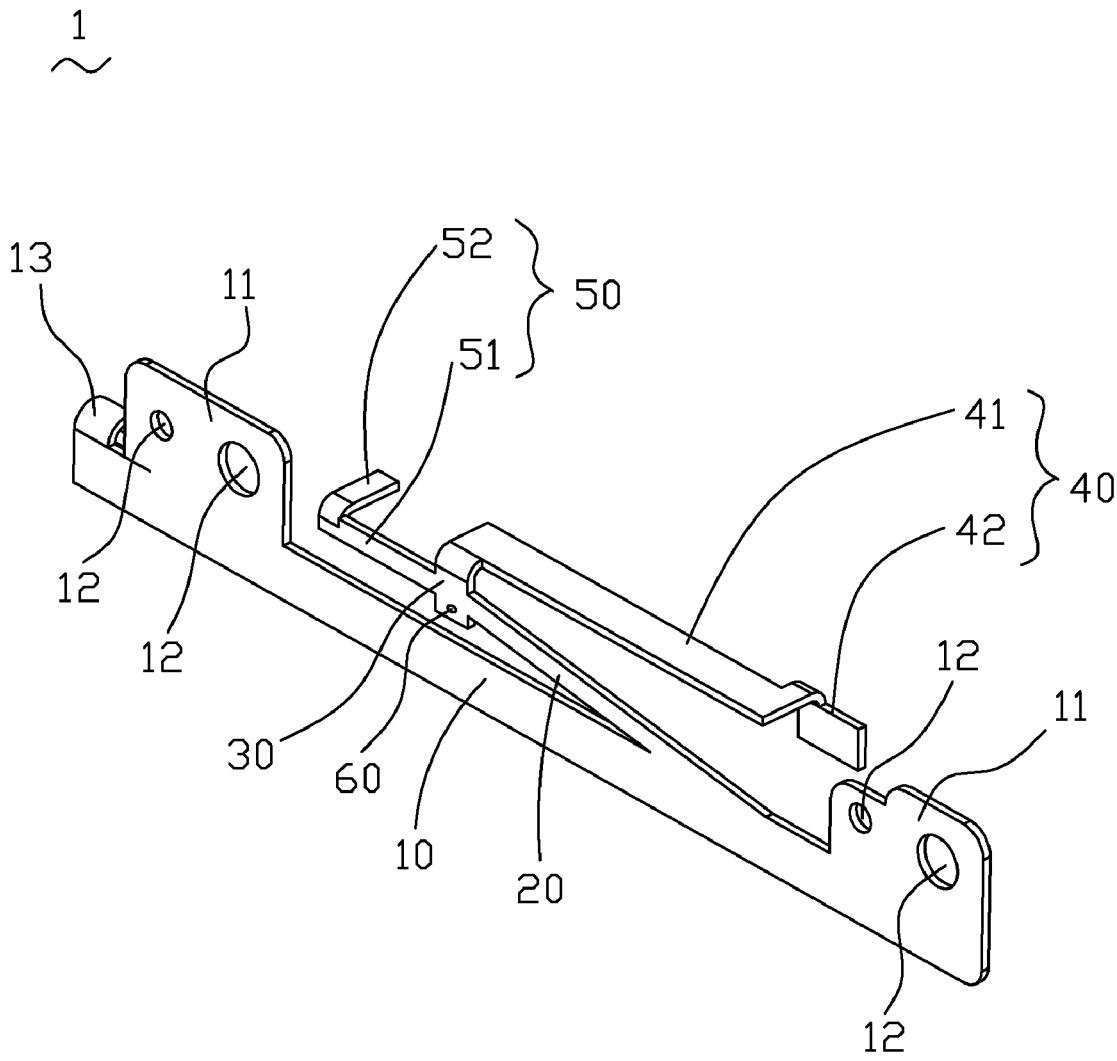
FIG. 1 shows a front view of a dual-band antenna according to the present invention.
Figure 2:
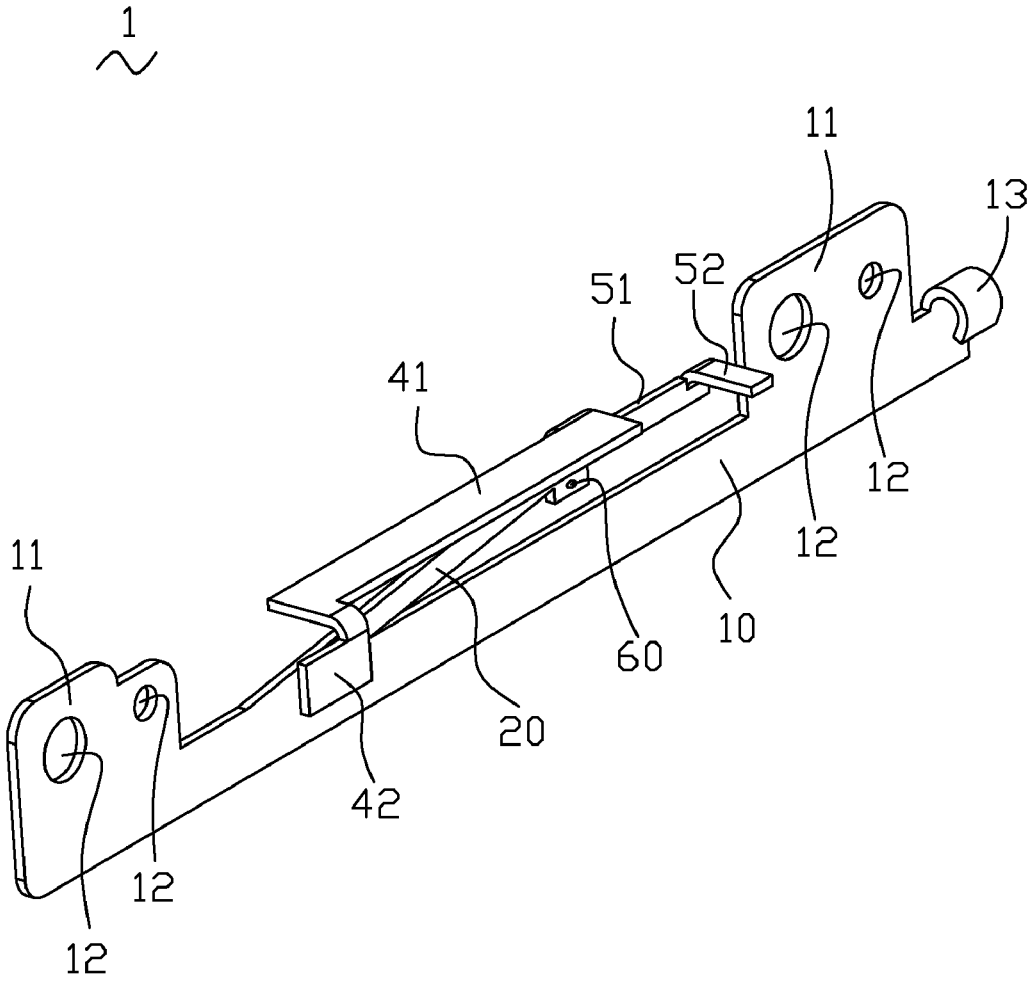
FIG. 2 shows a rear view of the dual-band antenna according to the present invention.

Please refer to FIG. 1 and FIG. 2. A preferred embodiment of the dual-band antenna 1 according to the present invention is shown. The dual-band antenna 1 has a ground portion 10, a short portion 20, a connection portion 30, a first radiating portion 40 and a second radiating portion 50.

In this case, the ground portion 10 is an elongated plate and defines opposite ends. Two fixing plates 11 are arranged at opposite ends of the ground portion 10 and extend from one side of the ground portion 10. The fixing plates 11 and the ground portion 10 are arranged at same plane. Pluralities of through holes 12 are opened on the fixing plates 11. An arc portion 13 is arranged at one end of the ground portion 10.

The short portion 20 is formed as a strip. The short portion 20 extends from one side of the ground portion 10. In this case, the short portion 20 extends between the fixing plates 11. The short portion 20 extends from which is close to one of the fixing plates 11, and obliquely and straight extends to the other fixing plate 11. In this case, the short portion 20 and the ground portion 10 form an acute angle therebetween. In this case, the acute angle between the short portion 20 and the ground portion 10 is below than 45 degrees.

The connection portion 30 is formed as a rectangle and defines opposite sides. In this case, the connection portion 30 is separated from the ground portion 10. The free end of the short portion 20 and the second radiating portion 50 connect opposite sides of the connection portion 30 respectively. A feeding point 60 is arranged at the connection portion 30 and close to the short portion 20.

The first radiating portion 40 connects the connection portion 30 and has a first section 41 and a second section 42 perpendicular to the first section 41. In this case, the first section 41 of the first radiating portion 40 is parallel to the ground portion 10. The first section 41 and the second section 42 of the first radiating portion 40 both are formed as a rectangle plate. The first section 41 of the first radiating portion 40 defines two ends.

One end of the first section 41 of the first radiating portion 40 connects the connection portion 30. The other end of the first section 41 of the first radiating portion 40 connects the second section 42 of the first radiating portion 40. In this case, the short portion 20 is arranged between the ground portion 10 and the first radiating portion 40.

The second radiating portion 50 has a third section 51 and a fourth section 52 perpendicular to the third section 51, the third section 51 is parallel to the ground portion 10. The third section 51 and the fourth section 52 of the second radiating portion 50 are both a strip. The third section 51 of the second radiating portion 50 defines two ends. One end of the third section 51 of the second radiating portion 50 connects the connection portion 30. The other end of the third section 51 connects the fourth section 52 of the second radiating portion 50.

In this case, the ground portion 10, the fixing plates 11, the short portion 20, the connection portion 30 and the third section 51 of the second radiating portion 50 are on same plane. In this case, the short portion 20, the connection portion 30, the first radiating portion 40 and second radiating portion 50 are arranged between the fixing plates 11.

The dual-band antenna 1 is configured in an electrical device (not shown in figures) through the fixing plates 11, the through holes 12 and matching elements (not shown in the figures) corresponding to the through holes 12. A feeding cable (not shown in the figures) is fixed to the dual-band antenna 1 through the arc portion 13.

When the dual-band antenna 1 operates at wireless communication, the current is fed from the feeding point 60 and to the second section 42 of the first radiating portion 40 to obtain an electrical resonance corresponding to a quarter wavelength corresponding to a first frequency range covering 2.4 GHz. The current is fed from the feeding point 60 and to the fourth section 52 of the second radiating portion 50 to obtain an electrical resonance corresponding to a quarter wavelength corresponding to a second frequency range covering 5.2 GHz.

The size, the width and the length of the first radiating portion 40 have a most pronounced effect on antenna characteristics in the first frequency range. Furthermore, the size, the width and the length of the second radiating portion 50 have a most pronounced effect on antenna characteristics in the second frequency range.

The current is fed from the feeding point 60 and passed the short portion 20 and then fed to the ground portion 10 to form a function as an inductance for replacing a matching circuit. Because the short portion 20 is obliquely arranged between the ground portion 10 and the first radiating portion 40, the distance between the first radiating portion 40 and the short portion 20 where the ground portion 10 is connected is the maximum, and the distance between the first radiating portion 40 and the short portion 20 where the connection portion 30 is connected is the minimum.

The interference between the short portion 20 and the first radiating portion 40 is corresponding to the distance between the short portion 20 and the first radiating portion 40. The interference between the short portion 20 and the first radiating portion 40 is the maximum while the distance between the short portion 20 and the first radiating portion 40 is the maximum. The interference between the short portion 20 and the first radiating portion 40 is the minimum while the distance between the short portion 20 and the first radiating portion 40 is the minimum.

Therefore, the interference between the short portion 20 and the first radiating portion 40 is getting reduced while the distance between the short portion 20 and the first radiating portion 40 is getting far. In this case, the average interference between the short portion 20 and the first radiating portion 40 is reduced because the short portion 20 is obliquely arranged between the ground portion 10 and the first radiating portion 40.

Figure 3:
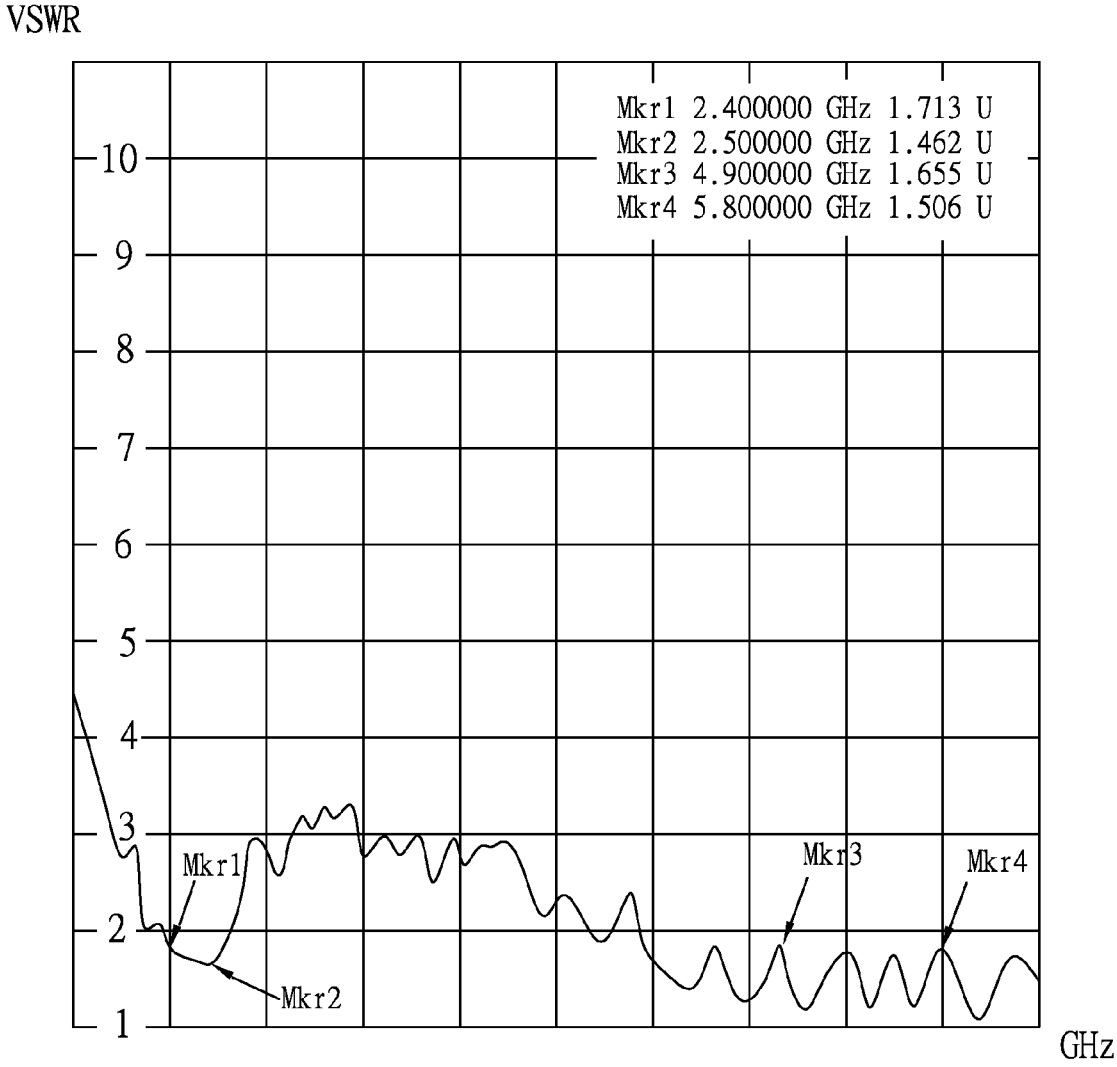
FIG. 3 shows a Voltage Standing Wave Ratio (VSWR) test chart of the dual-band antenna.

Please refer to FIG. 3, which shows a Voltage Standing Wave Ratio (VSWR) test chart of the dual-band antenna 1 when the dual-band antenna 1 operates at wireless communication. When the dual-band antenna 1 operates at 2.4 GHz (indicator Mkr1 in FIG. 3), the VSWR value is 1.713. When the dual-band antenna 1 operates at 2.5 GHz (indicator Mkr2 in FIG. 3), the VSWR value is 1.462. When the dual-band antenna 1 operates at 4.9 GHz (indicator Mkr3 in FIG. 3), the VSWR value is 1.655. When the dual-band antenna 1 operates at 5.8 GHz (indicator Mkr4 in FIG. 3), the VSWR value is 1.506. Therefore, the VSWR value is below the minimum value 2 when the dual-band antenna 1 operates at 2.4 GHz and 5.2 GH.

Figure 4:
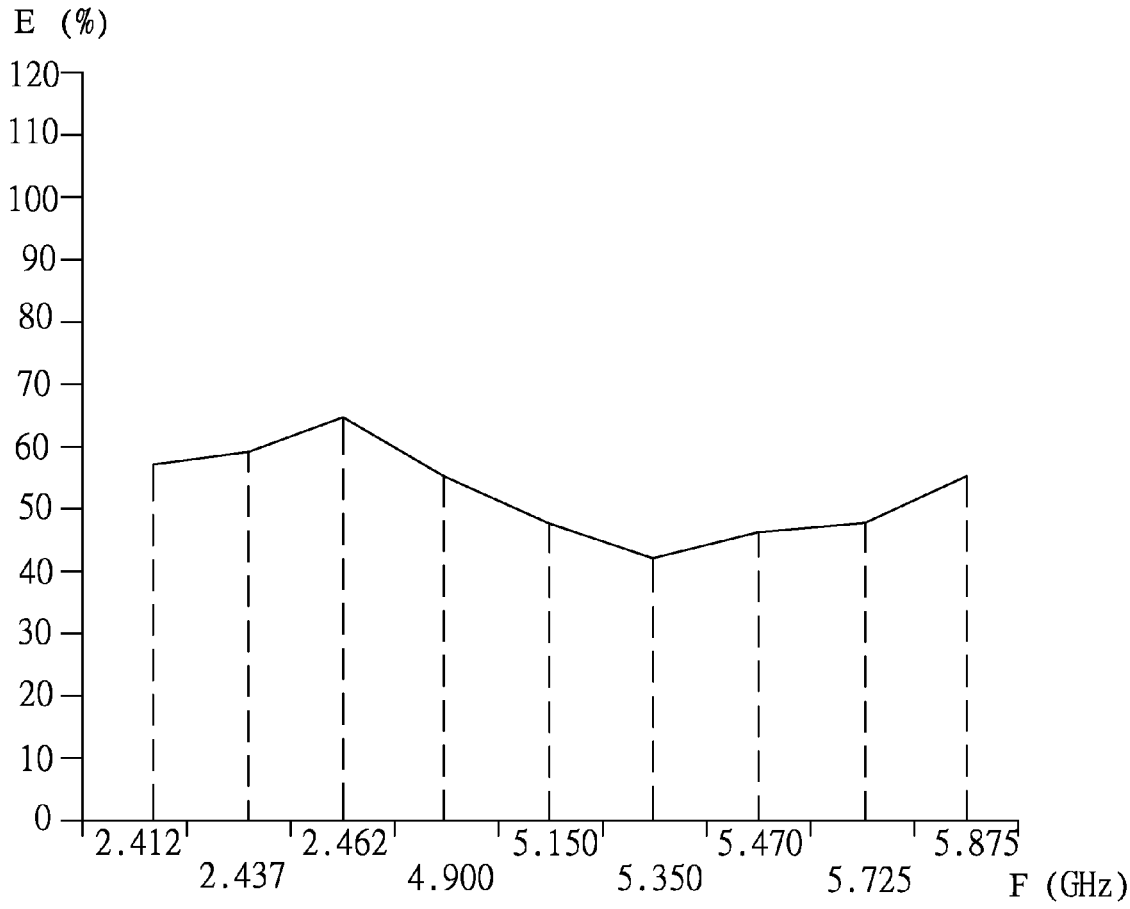
FIG. 4 is a graph showing the efficiency E against frequency F in GHz for the dual-band antenna.

Please refer to FIG. 4, which shows the efficiency E against frequency F in GHz for the dual-band antenna 1. When the dual-band antenna 1 operates at first frequency range covering between 2.4 GHz and 2.5 GHz, the efficiency is between 57 percentages and 65 percentages. When the dual-band antenna 1 operates at first frequency range covering between 4.9 GHz and 5.8 GHz, the efficiency is between 43 percentages and 60 percentages.

Therefore, the dual-band antenna 1 obtains the first frequency range covering 2.4 GHz corresponding to operation frequency of the IEEE 802.11b/g standard. The dual-band antenna 1 also obtains the second frequency range covering 5.2 GHz corresponding to operation frequency of the IEEE 802.11a standard. Because the short portion 20 is obliquely arranged between the ground portion 10 and the first radiating portion 40, the efficiency of the dual-band antenna 1 operating at the first frequency range is higher than 57 percentages.

Furthermore, the present invention is not limited to the embodiments described above; various additions, alterations and the like may be made within the scope of the present invention by a person skilled in the art. For example, respective embodiments may be appropriately combined.

What is claimed is:

1. A dual-band antenna, comprising:

a ground portion;

a short portion extending from said ground portion to form an acute angle between said ground portion and said short portion;

a connection portion defining opposite sides, one side of said connection portion connected to the free end of said short portion;

a first radiating portion connected to said connection portion, said short portion arranged between said ground portion and said first radiating portion;

a second radiating portion connected to the other side of said connection portion; and a feeding point arranged at said connection portion and close to said short portion.

2. The dual-band antenna as claimed in claim 1, wherein said short portion is formed as a strip, and obliquely and straight extending from said ground portion.

3. The dual-band antenna as claimed in claim 1, wherein said first radiating portion has a first section defining opposite ends, and a second section perpendicular to said first section, one end of said first section connects said connection portion, the other end of said first section connects said second section.

4. The dual-band antenna as claimed in claim 1, wherein said second radiating portion has a third section parallel to said ground portion, and a fourth section perpendicular to said third section, said third section has opposite ends respectively connected to said connection portion and said fourth section.

5. The dual-band antenna as claimed in claim 1, wherein said ground portion is formed as an elongated plate and has opposite ends, two fixing plates having plurality of through holes thereon are respectively arranged at opposite ends of said ground portion.

6. The dual-band antenna as claimed in claim 5, wherein said short portion, said connection portion and said first radiating portion are arranged between said fixing plates.

7. The dual-band antenna as claimed in claim 5, further comprising an arc portion arranged at one end of said ground portion.

8. The dual-band antenna as claimed in claim 5, wherein said acute angle between said ground portion and said short portion is below than 45 degrees.

9. A dual-band antenna, comprising:

a ground portion;

a connection portion with a feeding point defining a first side and a second side opposite to said first side, and separated from said ground portion;

a short portion connected to said ground portion and said first side of said connection portion to form an acute angle between said ground portion and said short portion;

a first radiating portion connected to said connection portion and parallel to said ground portion, said short portion arranged between said ground portion and said first radiating portion, wherein said feeding point is close to said short portion and said short portion is formed as a function of an inductance; and a second radiating portion connected to said second side of said connection portion.

10. The dual-band antenna as claimed in claim 9, wherein said first radiating portion and said connection portion resonate to obtain a lower frequency range.

11. The dual-band antenna as claimed in claim 9, further wherein said second radiating portion and said connection portion resonate to obtain a higher frequency range.

12. The dual-band antenna as claimed in claim 9, further comprising at least one fixing plate with at least one through hole thereon formed at said ground portion for fixing said antenna to an electrical device.

13. The dual-band antenna as claimed in claim 9, further comprising at least one arc portion formed at said ground portion for fixing a feeding cable to said antenna.

* * * * *